US006202214B1

(12) United States Patent
Light

(10) Patent No.: US 6,202,214 B1
(45) Date of Patent: Mar. 20, 2001

(54) PADDED SHOULDER PROTECTION DEVICE

(76) Inventor: Edward A. Light, 7135 S. Rutan, Wichita, KS (US) 67216

( * ) Notice: Subject to any disclaimer, the term of this patent is extended or adjusted under 35 U.S.C. 154(b) by 0 days.

(21) Appl. No.: 09/434,810

(22) Filed: Nov. 5, 1999

(51) Int. Cl.[7] ..... A41D 13/00
(52) U.S. Cl. ..... 2/45; 2/459; 2/268
(58) Field of Search ..... 2/459, 268, 455, 2/44, 45, 468, 327, 908, 461, 467; 128/878, 876; 602/4, 5, 20, 62; 224/257, 264, 265, 600

(56) References Cited

U.S. PATENT DOCUMENTS

| | | | | |
|---|---|---|---|---|
| 378,394 | * | 2/1888 | Haskins | 2/459 |
| 3,504,377 | * | 4/1970 | Biggs et al. | 2/455 |
| 3,906,944 | * | 9/1975 | Christen | 2/44 |
| 4,353,133 | * | 10/1982 | Williams | 2/45 |
| 4,493,115 | * | 1/1985 | Maier et al. | 2/45 |
| 5,181,906 | * | 1/1993 | Bauerfeind | 602/63 |
| 5,188,587 | * | 2/1993 | McGuire et al. | 602/20 |
| 5,319,806 | * | 6/1994 | Hermann et al. | 2/44 |
| 5,681,268 | * | 10/1997 | Radman | 602/20 |
| 5,701,611 | * | 12/1997 | Rector et al. | 2/455 |
| 5,765,735 | * | 6/1998 | Kimchi et al. | 224/264 |

* cited by examiner

*Primary Examiner*—Gloria M. Hale
*Assistant Examiner*—Tejash Patel

(57) ABSTRACT

A padded shoulder protection device for essentially protecting against micro-trauma to one's shoulder due to carrying objects on the shoulder. The padded shoulder protection device includes a semi-flexible layered and padded member having four projecting portions, a neck-receiving edge, and further includes eight straps and four buckles with four of the straps being attached to respective projecting portions and the remaining four straps being attached either to a padded belt member or to four strap members with each strap member having a respective suspender-like clip attached thereto. The semi-flexible layered and padded member includes a layer of foam material, a layer of plastic material, and a layer of either rubber or leather.

15 Claims, 3 Drawing Sheets

PADDED SHOULDER PROTECTION DEVICE

BACKGROUND OF THE INVENTION

1. Field of the Invention

The present invention relates to a means to securely pad and protect one's shoulder and more particularly pertains to a new padded shoulder protection device for essentially protecting against micro-trauma to one's shoulder due to carrying objects on the shoulder.

2. Description of the Prior Art

The use of a means to securely pad and protect one's shoulder is known in the prior art. More specifically, a means to securely pad and protect one's shoulder heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,487,346; U.S. Pat. No. 5,681,268; U.S. Pat. No. 5,063,941; U.S. Pat. No. 5,701,611; U.S. Pat. No. 5,765,735; and U.S. Pat. No. 5,450,995.

While these devices fulfill their respective, particular objectives and requirements, the aforementioned patents do not disclose a new padded shoulder protection device. The inventive device includes a semi-flexible layered and padded member having four projecting portions, a neck-receiving edge, and further includes eight straps and four buckles with four of the straps being attached to respective projecting portions and the remaining four straps being attached either to a padded belt member or to four strap members with each strap member having a respective suspender-like clip attached thereto. The semi-flexible layered and padded member includes a layer of foam material, a layer of plastic material, and a layer of either rubber or leather.

In these respects, the padded shoulder protection device according to the present invention substantially departs from the conventional concepts and designs of the prior art, and in so doing provides an apparatus primarily developed for the purpose of essentially protecting against micro-trauma to one's shoulder due to carrying objects on the shoulder.

SUMMARY OF THE INVENTION

In view of the foregoing disadvantages inherent in the known types of a means to securely pad and protect one's shoulder now present in the prior art, the present invention provides a new padded shoulder protection device construction wherein the same can be utilized for essentially protecting against micro-trauma to one's shoulder due to carrying objects on the shoulder.

The general purpose of the present invention, which will be described subsequently in greater detail, is to provide a new padded shoulder protection device apparatus and method which has many of the advantages of the a means to securely pad and protect one's shoulder mentioned heretofore and many novel features that result in a new padded shoulder protection device which is not anticipated, rendered obvious, suggested, or even implied by any of the prior art a means to securely pad and protect one's shoulder, either alone or in any combination thereof.

To attain this, the present invention generally comprises a semi-flexible layered and padded member having four projecting portions, a neck-receiving edge, and further includes eight straps and four buckles with four of the straps being attached to respective projecting portions and the remaining four straps being attached either to a padded belt member or to four strap members with each strap member having a respective suspender-like clip attached thereto. The semi-flexible layered and padded member includes a layer of foam material, a layer of plastic material, and a layer of either rubber or leather.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new padded shoulder protection device which has many of the advantages of the a means to securely pad and protect one's shoulder mentioned heretofore and many novel features that result in a new padded shoulder protection device which is not anticipated, rendered obvious, suggested, or even implied by any of the prior art a means to securely pad and protect one's shoulder, either alone or in any combination thereof.

It is another object of the present invention to provide a new padded shoulder protection device which may be easily and efficiently manufactured and marketed.

It is a further object of the present invention to provide a new padded shoulder protection device which is of a durable and reliable construction.

An even further object of the present invention is to provide a new padded shoulder protection device which is susceptible of a low cost of manufacture with regard to both materials and labor, and which accordingly is then susceptible of low prices of sale to the consuming public, thereby making such padded shoulder protection device economically available to the buying public.

Still yet another object of the present invention is to provide a new padded shoulder protection device which provides in the apparatuses and methods of the prior art some of the advantages thereof, while simultaneously overcoming some of the disadvantages normally associated therewith.

Still another object of the present invention is to provide a new padded shoulder protection device for essentially protecting against micro-trauma to one's shoulder due to carrying objects on the shoulder.

Yet another object of the present invention is to provide a new padded shoulder protection device which includes a semiflexible layered and padded member having four projecting portions, a neck-receiving edge, and further includes eight straps and four buckles with four of the straps being attached to respective projecting portions and the remaining four straps being attached either to a padded belt member or to four strap members with each strap member having a respective suspender-like clip attached thereto. The semi-flexible layered and padded member includes a layer of foam material, a layer of plastic material, and a layer of either rubber or leather.

Still yet another object of the present invention is to provide a new padded shoulder protection device that relieves the strain placed on a person's shoulder when carrying an object thereupon.

Even still another object of the present invention is to provide a new padded shoulder protection device that is easily and quickly placed upon one's shoulder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
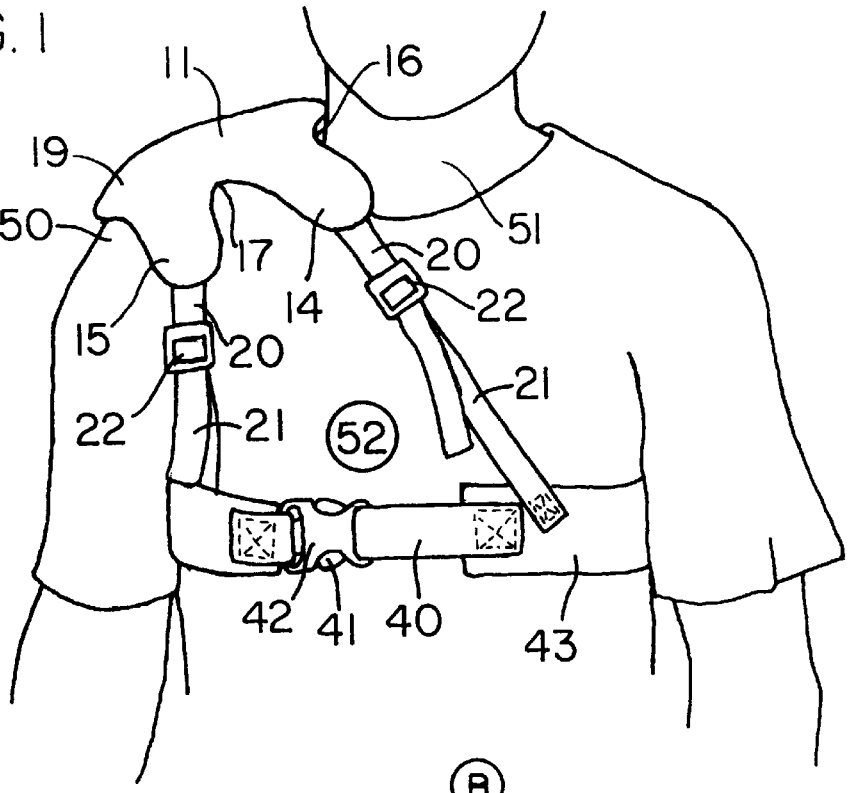
FIG. 1 is a front elevational view of one embodiment of a new padded shoulder protection device according to the present invention being put to use.
Figure 2:
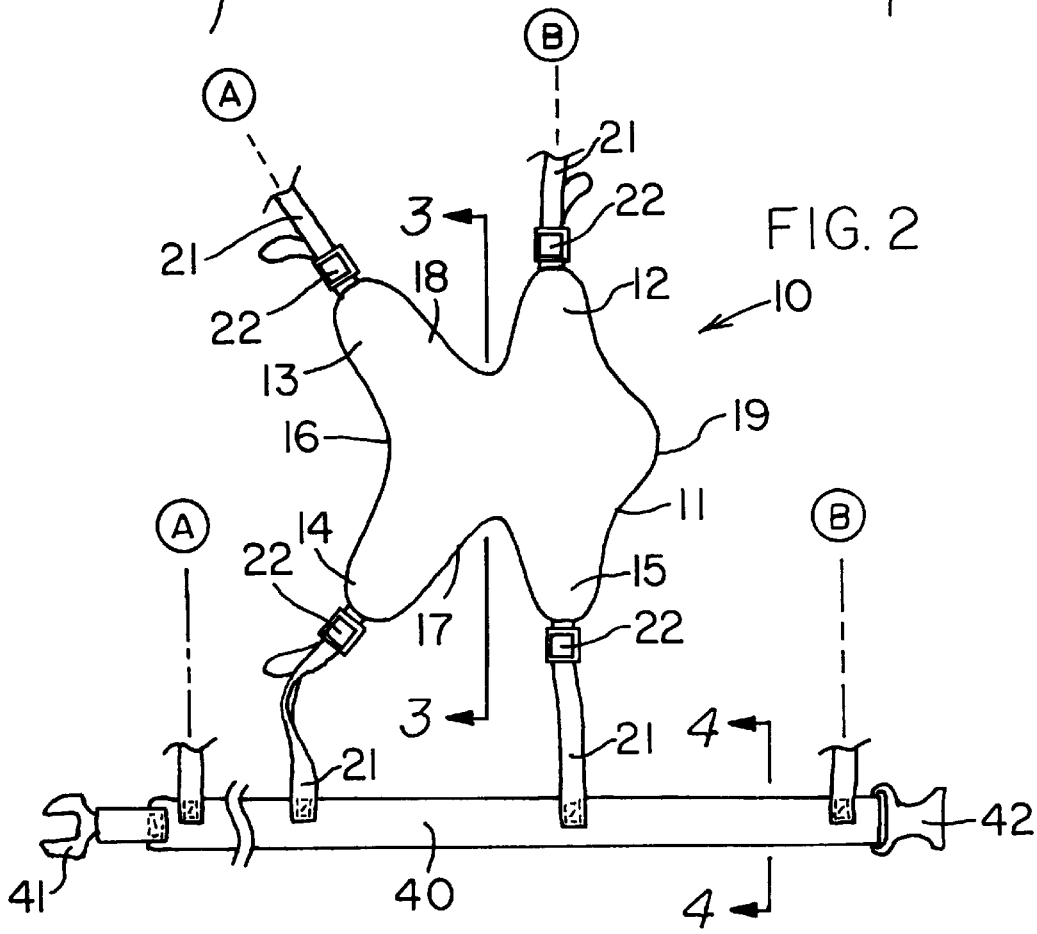
FIG. 2 is a front elevational view of one embodiment of the present invention.
Figure 3:
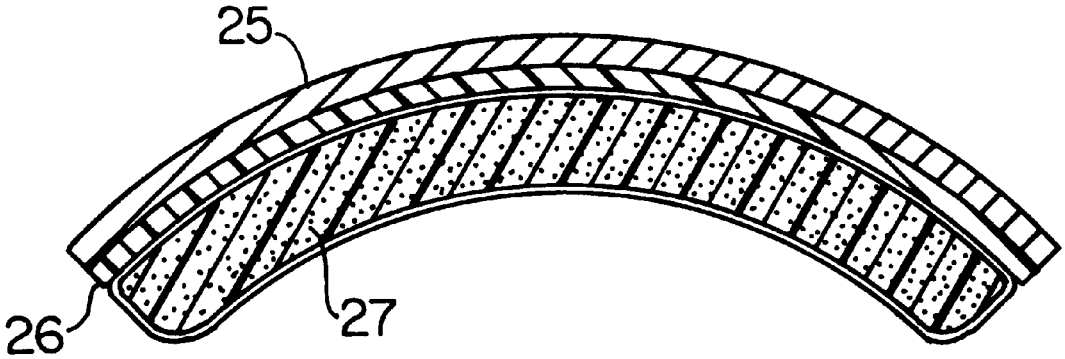
FIG. 3 is a side cross-sectional view of semi-flexible layered and padded member of the present invention.
Figure 4:
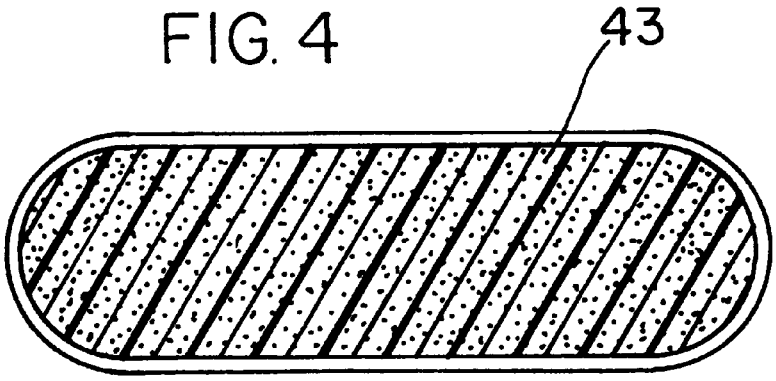
FIG. 4 is a cross-sectional view of the padded belt member of the present invention.
Figure 5:
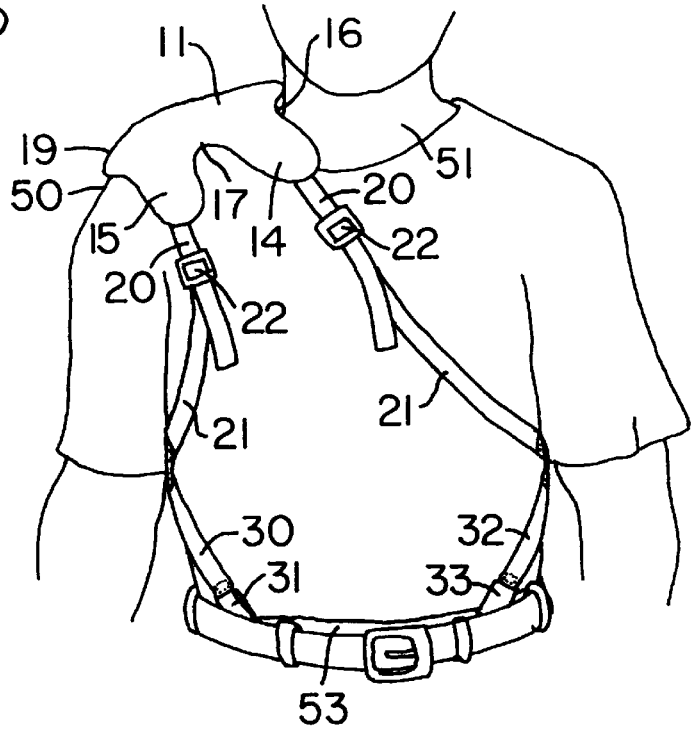
FIG. 5 is a front elevational view of a second embodiment of of the present invention being put to use.
Figure 6:
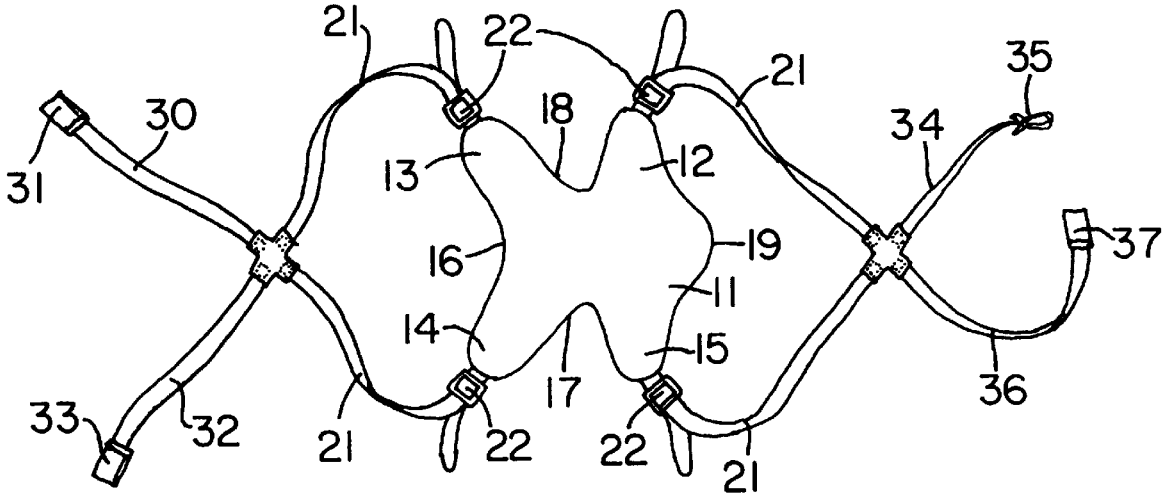
FIG. 6 is a front elevational view of the second embodiment of the present invention.

With reference now to the drawings, and in particular to FIGS. 1 through 6 thereof, a new padded shoulder protection device embodying the principles and concepts of the present invention and generally designated by the reference numeral 10 will be described.

As best illustrated in FIGS. 1 through 6, the padded shoulder protection device 10 generally comprises a semi-flexible layered and padded member 11 having a definite thickness and further having a neck-receiving edge 16, a front edge 17, a back edge 18, a bottom side, a top side, and a plurality of projecting portions 12–15 extending from the edges 17,18 thereof. The projecting portions include a first 12 and second 13 projecting portions spaced apart and extending outwardly from the back edge 18, and further includes a third 14 and fourth 15 projecting portions spaced apart and extending outwardly from the front edge 17. The second 13 and third 14 projecting portions are spaced apart and angled so as to form an inwardly curved neck-receiving edge 16 adapted to receive a portion of person's neck 51. The second projecting portion 13 is essentially adapted to extend about a rear portion of a person's neck 51, and the third projecting portion 14 is essentially adapted to extend about a front portion of a person's neck 51. The semi-flexible layered and padded member 11 includes an outwardly curved edge 19 disposed opposite to the neck-receiving edge 16 and is adapted to cover an outer region of a person's shoulder 50. The first 12 and second 13 projecting portions are adapted to extend to a backside of a person's shoulder 50, and the third 14 and fourth 15 projecting portions are adapted to extend to a front side of a person's shoulder 50. The semiflexible layered and padded member 11 also includes an inner layer 27, a middle layer 26, and an outer layer 25 with the inner layer 27 including a closed cell foam material enclosed within a neoprene material. The middle layer 26 includes a plastic material, and the outer layer 25 includes a material selected from a group consisting of rubber and leather.

A plurality of adjustable strap means having ends securely attached to the semi-flexible layered and padded member 1 include a plurality of buckles 22. Each of the adjustable strap means includes a first strap 20 having an end securely attached to a respective one of the projecting portions 12–15 and having another end securely attached to a respective one of the buckles 22, and further includes a second strap 21 having a first end securely attached to a respective one of the buckles 22 and having a second end securely attached to the fastening means. As a first embodiment, a means for fastening the semi-flexible layered and padded member 11 about a person's shoulder 50 includes four strap members 30,32,34,36 each having suspender-like clips 31,33,35,37 securely and conventionally attached to a first end thereof and being adapted for clipping onto a person's pants 53. The strap members 30,32,34,36 each has a second end which is securely and conventionally attached to the second ends of the second straps 21. As a second embodiment, the fastening means includes a padded belt member 40 having a fastener member 41 securely and conventionally attached at one end thereof and having a fastener-receiving member 42 securely and conventionally attached at the other end thereof, the padded belt member 40 being adapted to fastened about a person's body just below one's chest 52. The belt member 40 includes a foam material 43 enclosed within a fabric material.

In use, the user places the semi-flexible layered and padded member 11 upon the shoulder 50 needed to be protected and secures the fastening means about the person's body either with the belt member 40 or with the strap members. The user can then comfortably carry objects upon the shoulder with the semi-flexible layered and padded member 11 so as to protect one's shoulder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A padded shoulder protection device comprising:

a semi-flexible layered and padded member having a thickness and further having a neck-receiving edge, a front edge, a back edge, a bottom side, a top side, and a plurality of projecting portions, one of said plurality of projecting portions extending from said neck-receiving edge, said front edge, said back edge;

a plurality of adjustable strap means having ends securely attached to said semi-flexible layered and padded member;

a means for fastening said semi-flexible layered and padded member about a person's shoulder; and wherein said projecting portions include a first and second projecting portions spaced apart and extending outwardly from said back edge, and further includes a third and fourth projecting portions spaced apart and extending outwardly from said front edge.

2. A padded shoulder protection device as described in claim 1, wherein said second and third projecting portions are spaced apart and angled so as to form an inwardly curved neck-receiving edge adapted to receive a portion of person's neck, said second projecting portion being adapted to extend about a rear portion of a person's neck and said third projecting portion being adapted to extend about a front portion of a person's neck.

3. A padded shoulder protection device as described in claim 1, wherein said semi-flexible layered and padded member includes an outwardly curved edge disposed opposite to said neck-receiving edge and adapted to cover an outer region of a person's shoulder.

4. A padded shoulder protection device as described in claim 1, wherein said first and second projecting portions are adapted to extend to a backside of a person's shoulder and said third and fourth projecting portions are adapted to extend to a front side of a person's shoulder.

5. A padded shoulder protection device as described in claim 1, wherein said semi-flexible layered and padded member includes an inner layer, a middle layer, and an outer layer.

6. A padded shoulder protection device as described in claim 5, wherein said inner layer includes a closed cell foam material enclosed within a neoprene material.

7. A padded shoulder protection device as described in claim 6, wherein said middle layer includes a plastic material.

8. A padded shoulder protection device as described in claim 7, wherein said outer layer includes a material selected from a group consisting of rubber and leather.

9. A padded shoulder protection device as described in claim 1, wherein said adjustable strap means includes a plurality of buckles, each of said adjustable strap means including a first strap having an end securely attached to a respective one of said projecting portions and having another end securely attached to a respective one of said buckles, and further including a second strap having a first end securely attached to a respective one of said buckles and having a second end securely attached to said fastening means.

10. A padded shoulder protection device as described in claim 9, wherein said fastening means includes a plurality of strap members each having suspender-like clips securely attached to a first end thereof and being adapted for clipping onto a person's pants, said strap members each having a second end which is securely attached to said second ends of said second straps.

11. A padded shoulder protection device as described in claim 9, wherein said fastening means includes a padded belt member having a fastener member securely attached at one end thereof and having a fastener-receiving member securely attached at the other end thereof, said padded belt member being adapted to fastened about a person's body just below one's chest.

12. A padded shoulder protection device as described in claim 11, wherein said belt member includes a foam material enclosed within a fabric material.

13. A padded shoulder protection device comprising:

a semi-flexible layered and padded member having a definite thickness and further having a neck-receiving edge, a front edge, a back edge, a bottom side, a top side, and a plurality of projecting portions extending from said edges thereof, said projecting portions including a first and second projecting portions spaced apart and extending outwardly from said back edge, and further including a third and fourth projecting portions spaced apart and extending outwardly from said front edge, said second and third projecting portions being spaced apart and angled so as to form an inwardly curved neck-receiving edge adapted to receive a portion of person's neck, said second projecting portion essentially adapted to extend about a rear portion of a person's neck and said third projecting portion essentially adapted to extend about a front portion of a person's neck, said semi-flexible layered and padded member including an outwardly curved edge disposed opposite to said neck-receiving edge and adapted to cover an outer region of a person's shoulder, said first and second projecting portions being adapted to extend to a backside of a person's shoulder and said third and fourth projecting portions being adapted to extend to a front side of a person's shoulder, said semi-flexible layered and padded member also including an inner layer, a middle layer, and an outer layer said inner layer including a closed cell foam material enclosed within a neoprene material, said middle layer including a plastic material, said outer layer including a material selected from a group consisting of rubber and leather;

a plurality of adjustable strap means having ends securely attached to said semi-flexible layered and padded member, said adjustable strap means including a plurality of buckles, each of said adjustable strap means including a first strap having an end securely attached to a respective one of said projecting portions and having another end securely attached to a respective one of said buckles, and further including a second strap having a first end securely attached to a respective one of said buckles and having a second end securely attached to said fastening means; and a means for fastening said semi-flexible layered and padded member about a person's shoulder including a plurality of strap members each having suspender-like clips securely attached to a first end thereof and being adapted for clipping onto a person's pants, said strap members each having a second end which is securely attached to said second ends of said second straps.

14. A padded shoulder protection device as described in claim 13, wherein said fastening means includes a padded belt member having a fastener member securely attached at one end thereof and having a fastener-receiving member securely attached at the other end thereof, said padded belt member being adapted to fastened about a person's body just below one's chest.

15. A padded shoulder protection device as described in claim 13, wherein said belt member includes a foam material enclosed within a fabric material.

* * * * *